US011679403B1

(12) United States Patent
Graham et al.

(10) Patent No.: US 11,679,403 B1
(45) Date of Patent: Jun. 20, 2023

(54) TRAVEL DISPENSER FOR DISPENSING A FLUID

(71) Applicant: ries ries inc., Brooklyn, NY (US)

(72) Inventors: Megan Graham, Brooklyn, NY (US); Samantha Rose, San Clemente, CA (US); Lucas Zheng, Irvine, CA (US); Gary Chang, Irvine, CA (US)

(73) Assignee: Ries Ries Inc, Brooklyn, NY (US)

( * ) Notice: Subject to any disclaimer, the term of this patent is extended or adjusted under 35 U.S.C. 154(b) by 0 days.

(21) Appl. No.: 17/591,180

(22) Filed: Feb. 2, 2022

(51) Int. Cl.
*B05B 11/00* (2023.01)
*B05B 11/10* (2023.01)

(52) U.S. Cl.
CPC ..... *B05B 11/1042* (2023.01); *B05B 11/1047* (2023.01)

(58) Field of Classification Search
CPC ..... B05B 11/1042; B05B 11/1047; B05B 11/1074; B05B 11/1021; B05B 11/106; B05B 11/0032; B05B 11/1001; B05B 11/007; B05B 11/1064; B05B 11/028
See application file for complete search history.

(56) References Cited

U.S. PATENT DOCUMENTS 5,649,645 A * 7/1997 Demarest ..... B65D 83/205 222/153.07
6,375,045 B1 4/2002 Ki
6,685,062 B1 2/2004 Ki
6,763,978 B2 7/2004 Pritchett
7,328,856 B2 2/2008 Bloc
7,578,319 B2 8/2009 Behar
7,578,417 B2 8/2009 Son
7,588,170 B2 9/2009 Van Der Heijden
7,597,216 B2 10/2009 Behar
7,891,522 B2 2/2011 Law
8,066,153 B2 11/2011 Decottignies
8,118,193 B2 2/2012 Law
8,118,195 B2 2/2012 Decottignies
8,245,884 B2 8/2012 Byeon
8,308,029 B2 11/2012 Ki
(Continued)

OTHER PUBLICATIONS

Roberts Beauty: https://www.robertsbeauty.com/search?query=airless.

(Continued)

*Primary Examiner* — Vishal Pancholi
(74) *Attorney, Agent, or Firm* — The Law Offices of Roger S. Thompson

(57) ABSTRACT

A reusable, refillable airless fluid pump dispenser that is leakproof and designed specifically for travel. To operate the dispenser, the user presses an ergonomic depression on the top of the dispenser to engage the pump and cause a platform within the dispenser to rise, evenly distributing a fluid from the dispenser. The user can twist off the top and remove it from the body of the dispenser, which permits access to the interior of the dispenser to refill or wash as needed. The user may access the platform, raising it or pushing it back down to either adjust the amount of product they would like to fill or to reuse once product has been depleted. The attached outer cap of the top twists to lock, both blocking the nozzle from distributing any product and also preventing the top from depressing and engaging the pump.

20 Claims, 8 Drawing Sheets

(56) References Cited

U.S. PATENT DOCUMENTS

| | | | | |
|---|---|---|---|---|
| 8,439,230 | B2 * | 5/2013 | Hagen | B05B 11/1021 222/384 |
| 8,499,970 | B2 | 8/2013 | Yoo | |
| 8,556,130 | B2 | 10/2013 | Law | |
| 8,631,975 | B2 | 1/2014 | Lim | |
| 8,662,116 | B2 | 3/2014 | Dumont | |
| 8,783,523 | B2 | 7/2014 | Dumont | |
| 8,820,576 | B2 | 9/2014 | Jeong | |
| 8,939,323 | B2 | 1/2015 | Knight | |
| 9,114,416 | B2 | 8/2015 | Byeon | |
| 9,199,258 | B2 | 12/2015 | Pritchett et al. | |
| 9,248,462 | B2 | 2/2016 | Csaszar | |
| 9,277,797 | B2 * | 3/2016 | Chen | A45D 34/00 |
| 9,381,532 | B2 | 7/2016 | Bloc | |
| 9,486,826 | B2 | 11/2016 | Taberlet | |
| 9,815,592 | B2 | 11/2017 | Diaz | |
| 10,065,203 | B2 | 9/2018 | Moretti | |
| 10,077,135 | B2 | 9/2018 | Dupont | |
| 10,167,120 | B1 | 1/2019 | Levy | |
| 10,226,784 | B2 | 3/2019 | Moretti | |
| D854,415 | S | 7/2019 | Levy | |
| 10,427,181 | B2 | 10/2019 | Rossignol | |
| 10,464,088 | B2 | 11/2019 | Knight | |
| 10,493,475 | B1 | 12/2019 | Yang | |
| 10,524,558 | B2 | 1/2020 | Oh | |
| 10,561,221 | B2 | 2/2020 | Yan | |
| 10,569,285 | B2 | 2/2020 | Dambricourt | |
| D882,409 | S | 4/2020 | Wong | |
| 10,858,170 | B2 | 4/2020 | Eng | |
| 10,864,539 | B2 | 6/2020 | Delmon | |
| 10,794,445 | B2 | 10/2020 | Deman | |
| 10,822,143 | B2 | 11/2020 | Hon | |
| 10,835,910 | B2 | 11/2020 | Goutayer | |
| 10,898,916 | B1 | 1/2021 | Rossignol | |
| 10,919,060 | B2 | 2/2021 | Thompson | |
| 10,932,543 | B2 | 3/2021 | Lee | |
| 10,988,291 | B2 | 4/2021 | Levy | |
| 11,006,723 | B2 | 5/2021 | Kim | |
| 11,014,108 | B2 | 5/2021 | Knight | |
| D920,803 | S | 6/2021 | Davis | |
| D920,804 | S | 6/2021 | Davis | |
| 11,084,646 | B1 * | 8/2021 | Hwang | A45D 34/00 |
| 11,117,147 | B2 | 9/2021 | Knight | |
| 11,162,831 | B2 | 11/2021 | Yan | |
| 11,166,602 | B2 | 11/2021 | Ohnishi | |
| 11,534,785 | B2 * | 12/2022 | Seyda | B05B 11/028 |
| 2003/0038146 | A1 * | 2/2003 | Meshberg | B05B 11/1059 222/321.9 |
| 2011/0031282 | A1 * | 2/2011 | Hagen | B05B 11/1074 222/321.7 |

OTHER PUBLICATIONS

Silgan: https://silgandispensing.com/dispensers/airless/.

Humangear: https://www.rei.com/product/131776/humangear-gotoob-medium-squeeze-bottles-25-fl-oz-package-of-3?sku=1317760001&store=76&cm_mmc=PLA_Google%7C21700000001700551_13.

Amazon: https://www.amazon.com/Cosmetic-Dispenser-Refillable-Containers-Foundation/dp/B07YC9RFHS/refsr_1_1_sspa?keywords=airless%2Bpump%2Bbottle&qid=1639250050&sr=8-1-spon.

Amazon: https://www.amazon.com/LONGWAY-Frosted-Airless-Containers-Dispenser/dp/B082CV4824/ref=sr_1_3_sspa?keywords=airless%2Bpump%2Bbottle&qid-1639250050&sr=8-3-spons&spLa=.

* cited by examiner

TRAVEL DISPENSER FOR DISPENSING A FLUID

BACKGROUND OF THE INVENTION

1. Field of the Invention

The invention is directed to the field of portable dispensing apparatus.

More particularly, the invention is directed to a travel dispenser for dispensing a fluid capable of dispensing fluids from a sealed container without spillage, while allowing for the locking of the dispenser to prevent unwanted leakage or unintended dispensing of the contents of the apparatus.

2. Description of the Related Art

In our modern world, even in the age of the pandemic, people move about, whether locally, to the grocery store, or long distance, such as to foreign lands. Still, even when away from home, individuals have a need for carrying with them various items, whether for convenience, such as cosmetics or necessity, such as medications.

Many items, such as cosmetics and toiletries, usually come in containers of various sizes, with the most economical purchases being the larger containers. However, travelling with various large containers on one's person or in one's purse or briefcase, is not realistic. Thus, consumers often purchase different sized containers of favored products, for example, a large, economical size, for use at home, and a smaller "travel size" container for use when away. While offering some convenience, most travel-size containers are not refillable, meaning when the small amount of product contained therein is used up, the travel size container must be discarded and a new one purchased. This is inefficient, costing consumers needless expense and is also bad for the environment, leading to the disposal of millions of small bottles every year.

Furthermore, it is often difficult to dispense all of the product from the travel containers, leading to waste of the product.

To overcome these drawbacks, there are many available products in the marketplace which purport to address the issue by providing a refillable travel dispenser for cosmetics and other fluids.

These products, however, suffer from many drawbacks, including leaking, uneven dispensing of product, lack ergonomic features to enhance their utility, and are often difficult to re-fill.

There is thus a need in the marketplace for an improved travel dispenser for dispensing desired products, such as cosmetics, which dispenser is leakproof, convenient, refillable and efficient.

SUMMARY OF THE INVENTION

It is an object of the invention to provide an improved travel dispenser for dispensing a fluid which overcomes these, and other, deficiencies in the prior art.

It is a further object of the invention to provide a leakproof travel dispenser for dispensing metered amount of a fluid product.

It is yet another object of the invention to provide a refillable travel dispenser.

It is a still further object of the invention to provide a travel dispenser which does not require a body of air to be in the dispenser to operate.

Briefly stated, the invention is a reusable, refillable and airless pump dispenser for fluids. The dispenser is leakproof and particularly well suited for use while travelling. To operate the dispenser, the user presses an ergonomic depression on the top of the dispenser to engage the pump and cause a platform within the dispenser to rise, evenly distributing a fluid from the dispenser. The platform is movably mounted within the dispenser, and is substantially leakproof. In use, the user can twist off the top and remove it from the body of the dispenser, which permits access to the interior of the dispenser to refill or wash as needed. The user may access the platform, raising it or pushing it back down to either adjust the amount of product they would like to fill or to reuse once the dispenser is substantially empty, to render the dispenser substantially full. The attached outer cap of the top twists to lock, both blocking the nozzle from distributing any product and also preventing the top from depressing and engaging the pump.

For purposes of this application, it is intended that the term "fluid" as used herein includes any liquid, suspension, mixture or powdered solid. The preferred fluids for which the invention is directed are cosmetics and toiletries, such as lotions and shampoo, but may also include other types of fluids, such as condiments.

As used herein, the term "substantially" when used in conjunction with the words "empty" or "full", as in, for example, "substantially empty", means "nearly" as in "nearly empty", leaving such amount of fluid in the dispenser as the user may desire before refilling. When used in conjunction with the term "leakproof", as in "substantially leakproof", the term shall be understood to mean "as leakproof as manufacturing tolerances and practices may reasonably permit".

In accordance with an embodiment of the invention, the invention is a portable travel dispenser for dispensing a fluid. The dispenser of this embodiment comprises: a container having an interior for holding the fluid prior to the dispensing of the fluid; an outlet for the fluid as it is dispensed; a pump having a lower end which accesses the interior of the container and an upper end through which a metered amount of fluid may be conducted to the outlet, the pump having a one-way valve for preventing backflow of the fluid after the fluid has left the interior of the container; and a lock coupled to the outlet, the lock having an open position in which the fluid may be dispensed through the outlet and a closed position in which the fluid is prevented from flowing through the outlet.

In accordance with another embodiment of the invention, the invention is a portable travel dispenser for dispensing a fluid. The dispenser of this embodiment comprises: a container having an interior for holding the fluid prior to the dispensing of the fluid; an outlet for the fluid as it is dispensed; a pump having a lower end which accesses the interior of the container and an upper end through which a metered amount of fluid may be conducted to the outlet, the pump having a one-way valve for preventing backflow of the fluid after the fluid has left the interior of the container; a lock coupled to the outlet, the lock being rotatable between an open position in which the fluid may be dispensed through the outlet and a closed position in which the fluid is prevented from flowing through the outlet; and a housing in which the pump is removably mounted, the housing being threadedly engaged with the container to allow for securing the housing and the container together in a leakproof fashion.

In yet another embodiment of the invention, the invention is a portable travel dispenser for dispensing a fluid. The dispenser of this embodiment comprises: a container having an interior for holding the fluid prior to the dispensing of the fluid; an outlet for the fluid as it is dispensed; a pump having a lower end which accesses the interior of the container and an upper end through which a metered amount of fluid may be conducted to the outlet, the pump having a one-way valve for preventing backflow of the fluid after the fluid has left the interior of the container; a resilient spring for urging the pump into a desired position for dispensing the fluid; a lock coupled to the outlet, the lock being rotatable between an open position in which the fluid may be dispensed through the outlet and a closed position in which the fluid is prevented from flowing through the outlet; a housing in which the pump is removably mounted, the housing being threadedly engaged with the container to allow for securing the housing and the container together in a leakproof fashion; a platform movably mounted within the container with a leakproof seal, and configured to move from a full position in which the container is substantially full of the fluid, and an empty position in which the container is substantially empty of the fluid; wherein the platform may be accessed from the exterior of the container to allow for the dispensing of additional fluid in addition to the metered amount thereof.

In yet another embodiment of the inventive dispenser, the operation of the pump causes a vacuum to draw fluid out of the container.

Still further embodiments of the inventive dispenser additionally comprise an outer cap threadedly engaged to the housing to protect the pump against unintended actuation.

Other objects and features of the present invention will become apparent from the following detailed description of the presently preferred embodiments, considered in conjunction with the accompanying drawings, in which like numerals reference like elements. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
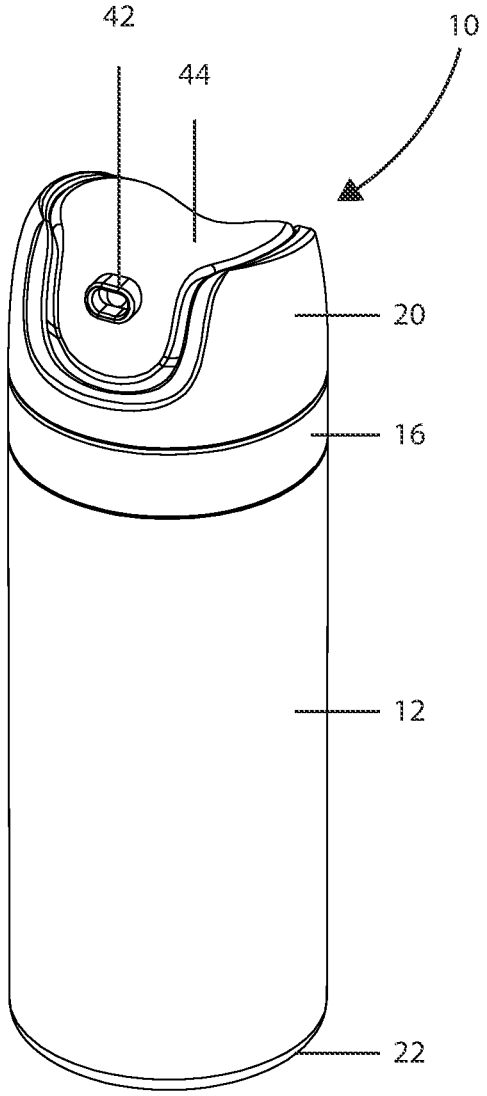
FIG. 1 shows a perspective view of the exterior of a travel dispenser for dispensing a fluid in accordance with one embodiment of the invention.
Figure 2:
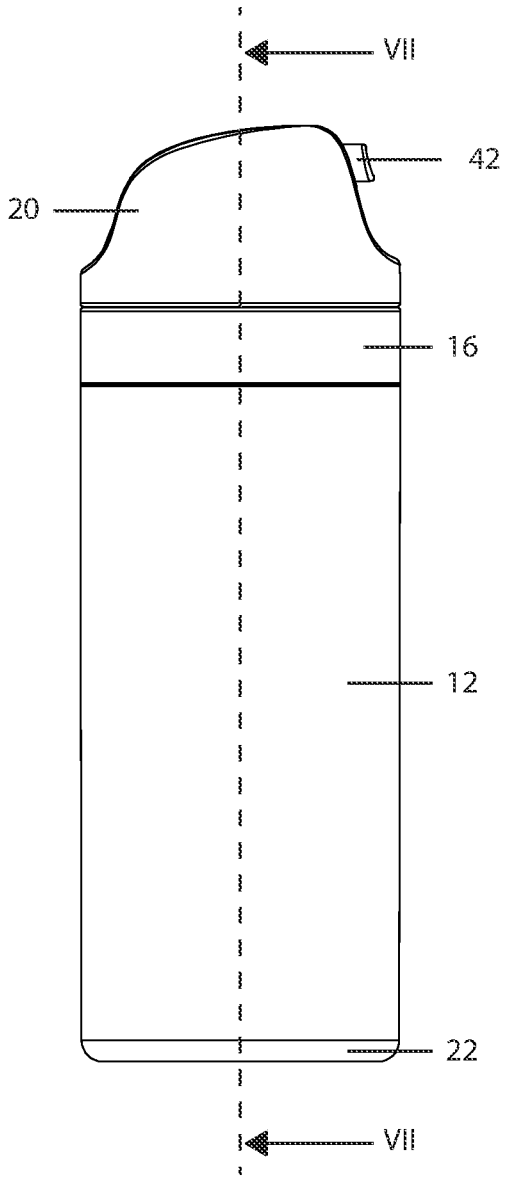
FIG. 2 shows a left side elevation of the dispenser of FIG. 1.
Figure 3:
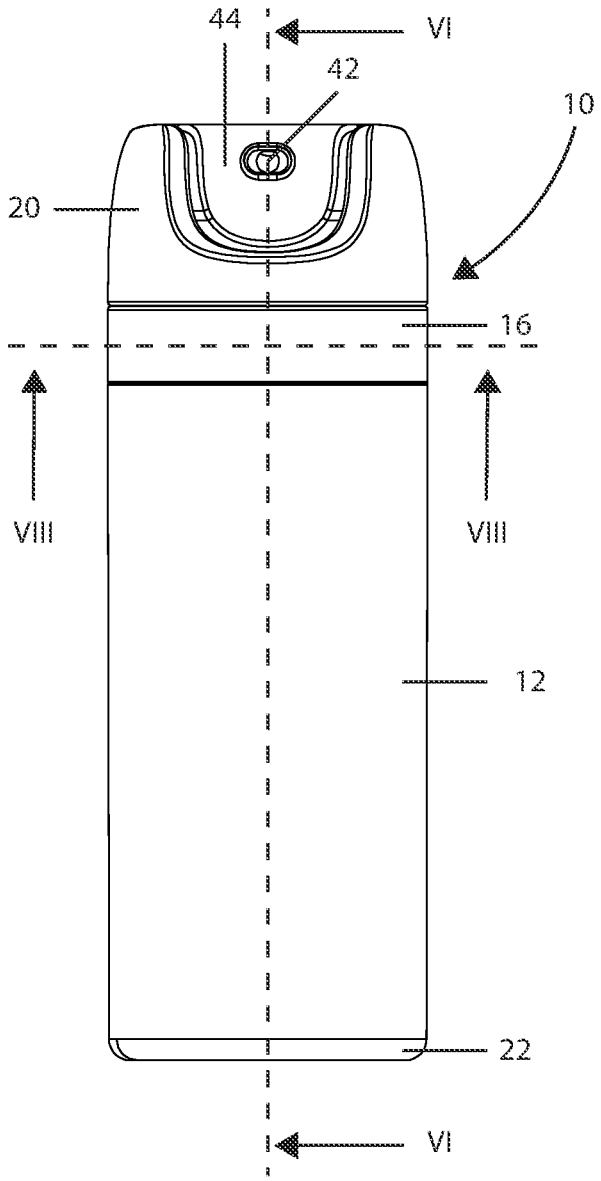
FIG. 3 shows a front elevation of the dispenser of FIG. 1.
Figure 4:
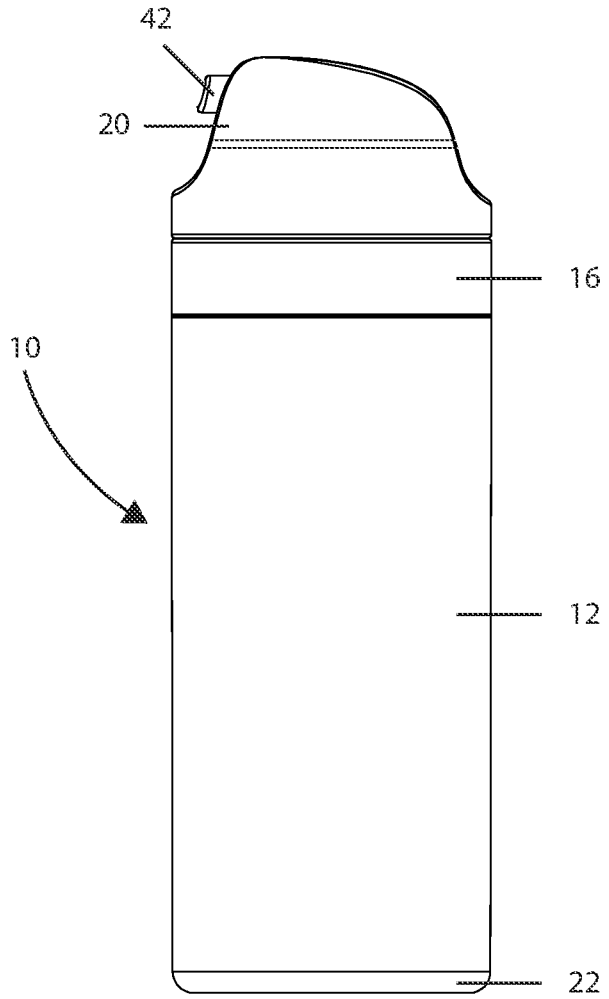
FIG. 4 shows a right side elevation of the dispenser of FIG. 1.
Figure 5:
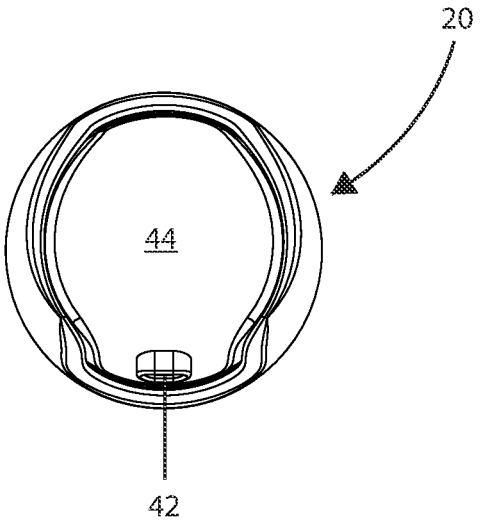
FIG. 5 shows a top plan view of the dispenser of FIG. 1.
Figure 6:
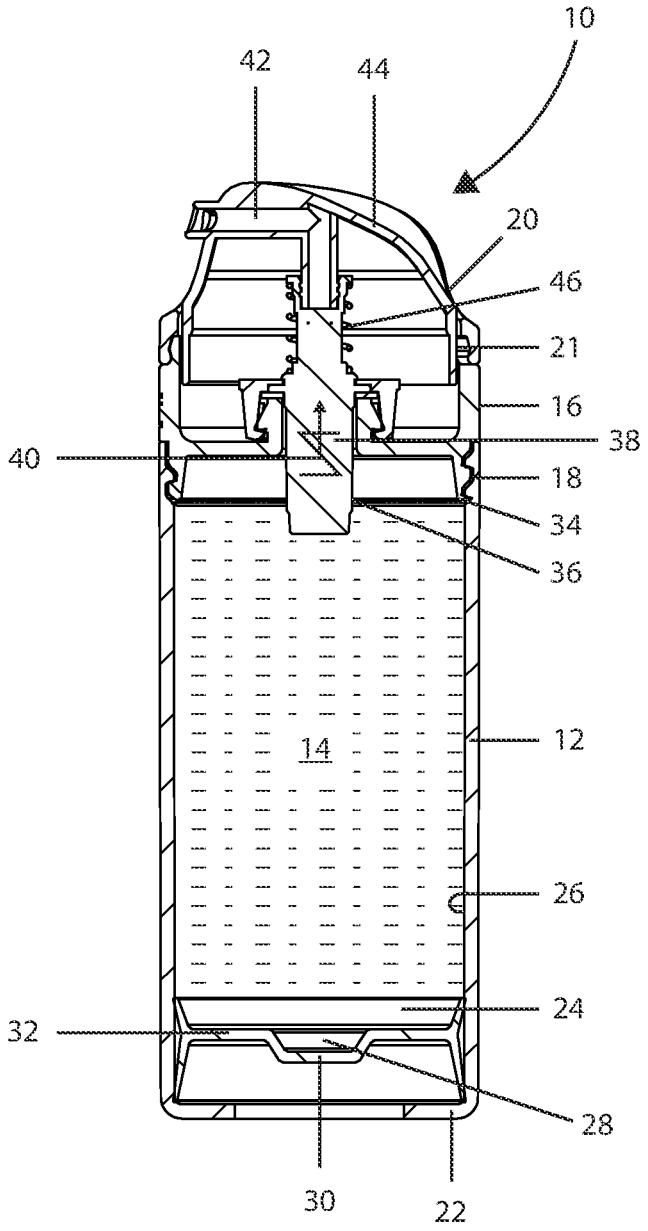
FIG. 6 shows a cross-section of the dispenser of FIG. 1 taken along the line VI-VI of FIG. 3.
Figure 7:
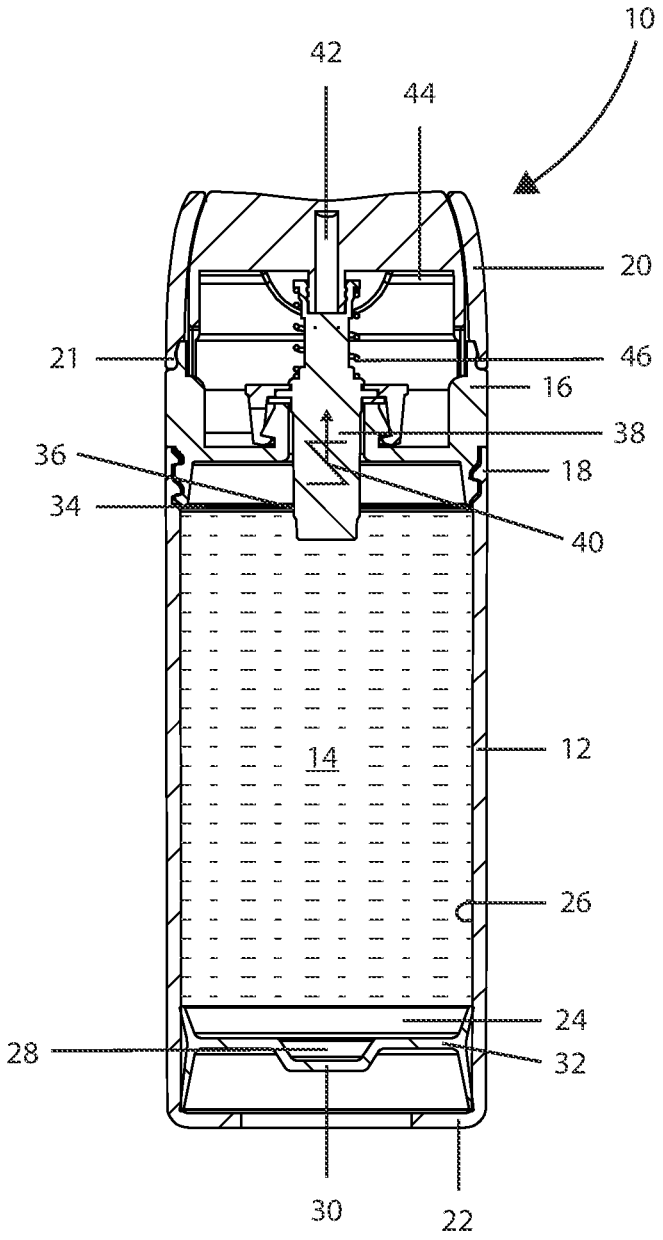
FIG. 7 shows a cross-section of the dispenser of FIG. 1 taken along the line VII-VII of FIG. 2.
Figure 8:
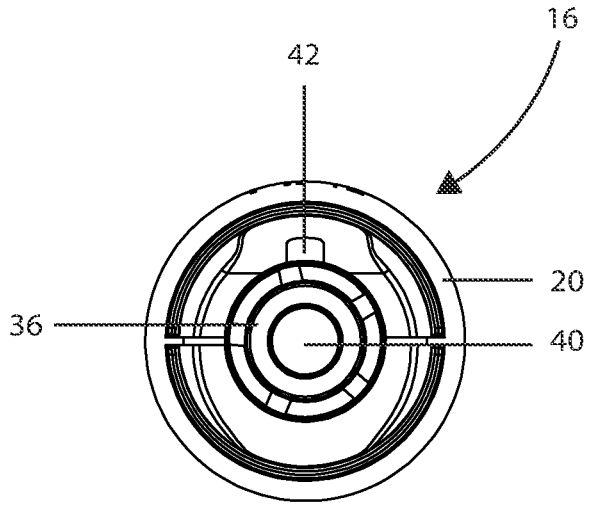
FIG. 8 shows a cross-section of the dispenser of FIG. 1 taken along the line VIII-VIII of FIG. 3.

FIGS. 1-8 show an inventive travel dispenser for dispensing a fluid, shown generally at 10 in accordance with one embodiment of the invention.

Dispenser 10 includes a container 12 for holding a fluid 14 (FIGS. 6 and 7) to be dispensed therefrom. Dispenser 10 further includes a housing 16 threadedly mounted to container 12 via a threaded connection 18 (FIGS. 6 and 7), and an outer cap 20 mounted to housing 16 at an end opposite to container 12, via a second threaded connection 21.

Container 12 is essentially a receptacle for containing fluid 14, and can be of any desired shape. In the preferred embodiment, container 12 is cylindrical, but it could as easily be square, rectangular or any other desired shape. The bottom 22 of container 12 is open, providing access to the underside thereof for reasons which will be described presently. Mounted within container 12 is a platform or piston 24, configured to fit snugly against an interior wall 26 of container 12, and thereby close the bottom of container 12 to prevent leakage of fluid 14 therefrom. For this purpose, platform 24 is configured to conform to the interior wall 26 of container 12 and may have a sealing ring (not individually labelled) mounted to the outer edge thereof to provide a leakproof seal.

Platform 24 is movable, preferably by sliding, within container 12 upon the application of pressure, as will be described. The underside of platform 24 preferably includes a button 28 which mates with an opening 30 in a bottom wall 32 of container 12, and provides a seal to the bottom of container 12.

Housing 16 includes an annular bottom wall 34 having an opening 36, and which acts as a top to the interior of container 12. A pump 38 is mounted within housing 16, and extends through opening 36 in bottom wall 34 of housing 16. Pump 38 is a conventional pump, which provides suction upon actuation to draw a material, in this case fluid 14, from one end thereof to the opposite end thereof, without permitting backflow therethrough by use of a one-way, or check, valve 40 (shown schematically). In this case, flow is only permitted from container 12 upwards (in the Figures). The outlet of valve 40 feeds into a nozzle 42 which conducts fluid 14 drawn from container 12 upwards and out of dispenser 10. An inner cap 44 is disposed atop housing 16, and is vertically movable with respect thereto, contacting nozzle 42. By depressing inner cap 44, nozzle 42 is caused to actuate pump 38 in conventional fashion to draw fluid 14 from container 12. A spring 46 biases nozzle 42 upwards into a position in which valve 40 is closed.

Inner cap 44 is preferably ergonomically shaped, as shown, with an indentation to accommodate a user's finger to provide an intuitive mechanism for actuating pump 38. Outer cap 20 is mounted outside of inner cap 44 to protect inner cap 44, and thereby pump 36, from unintended actuation. Inner cap 44 is also rotatable from a first, open position in which nozzle 42 may engage pump 38 into a second, closed or locked position in which nozzle 42 is disengaged from pump 38. Preferably, there are notches in one of the interior of outer cap 20 and the outer wall of inner cap 44, with a mating detent in the other thereof so that outer cap 20 may be secured in each of its first and second positions.

In operation, dispenser 10 provides a simple and convenient portable dispenser for a fluid.

To use, a user first disengages container 12 from housing 16, thereby opening container 12 for the introduction thereinto of fluid 14. In this position, platform 28 is preferably positioned at the very bottom of container 12 to hold the maximum amount of fluid 14, although the user may choose to introduce less than the maximum amount of fluid into container 12. The user then re-engages housing 16 with container 12, by screwing the two together via threaded connection 18, thereby sealing fluid 14 in an airtight condition so it does not leak and cannot be contaminated by the environment.

At the outset, inner cap 44 is preferably in the second, locked, position, so that dispenser 10 does not immediately begin to leak. Rather, dispenser 10 is ready for travel until the user desires to dispense fluid 14. Once the user so desires, the user rotates inner cap 44 into the first position so that nozzle 42 engages pump 38 and thereby enable the dispensing of fluid 14. To do so, the user depresses inner cap 44, thereby pushing against spring 46 and actuating pump 38 to create a vacuum to draw a metered amount of fluid 14 from container 12 through pump 38 and thence to nozzle 42, thereby providing fluid 14 to the user. The dispensing of fluid 14 from dispenser 10 creates a partial vacuum in container 12 thereby creating an upward pressure on platform 24 and causing platform 24 to travel upward along interior wall 26, maintaining the seal of container 12. The length of travel of inner cap 44 determines the maximum vertical travel of nozzle 42 and thus the amount of fluid to be dispensed, in a metered amount.

If the standard metered amount of fluid 14 is insufficient for the user, and the user does not wish to depress inner cap 44 repeatedly, the user has the option to leave nozzle 42 in the open position and push upwardly on button 30 on the bottom of platform 24, and thereby force an additional amount of fluid 14 through nozzle 42.

Once the desired amount of fluid 14 is dispensed, the user may rotate outer cap 20 into the locked position and prevent undesired leakage of fluid 14 from dispenser 10.

When container 12 is empty of fluid 14, or if the user wishes to dispense with any further use thereof, the user may disengage housing 16 from container 12 and wash container 12.

It will be appreciated by those of ordinary skill in the art that the described combination of features yields an improved travel dispenser for dispensing a fluid in which the user may safely and securely dispense fluid from a leakproof container in either metered amounts or "free form", thereby enhancing the utility and functionality of the dispenser.

The various components of dispenser 10 may be made of any suitable material. In the preferred embodiments, all of the elements, except for spring 46, are made of plastic. Spring 46 is preferably metal, but may be plastic, as well, so long as it is sufficiently durable to withstand repeated stress and rebounding. It will be appreciated by those of ordinary skill in the art that it would be possible to replace spring 46 with some other sort of resilient biasing element, such as a rubber ring, as a mere matter of design choice, with the only requirement being that the resilient member must bias nozzle 42 into a position in which it disengages from pump 44.

In the preceding Detailed Description, reference was made to the accompanying drawings, which form a part of this disclosure, and in which are shown illustrative specific embodiments of the invention. In this regard, directional terminology, such as "top", "bottom", "left", "right", "front", "back", "up", "down", etc., is used with reference to the orientation of the Figure(s) with which such terms are used. Because components of embodiments can be positioned in a number of different orientations, the directional terminology is used for purposes of ease of understanding and illustration only and is not to be considered limiting.

Additionally, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refillable portable travel dispenser for dispensing a fluid, the dispenser comprising:

a container having an interior for holding the fluid prior to the dispensing of the fluid;

an outlet for the fluid as it is dispensed;

a pump having a lower end which accesses said interior of said container and an upper end through which a metered amount of fluid may be conducted to said outlet, said pump having a one-way valve for preventing backflow of the fluid after the fluid has left said interior of said container; and a lock coupled to said outlet, said lock having an open position in which the fluid may be dispensed through said outlet and a closed position in which the fluid is prevented from flowing through said outlet;

whereby the dispenser may be at least partially disassembled to permit the refilling thereof.

2. The dispenser of claim 1, wherein said lock is rotatable between said open and closed positions;

wherein the rotation of said lock out of said open position and into said closed position causes said pump to disengage from at least one of said container and said outlet.

3. The dispenser of claim 1, further comprising a housing in which said pump is mounted.

4. The dispenser of claim 3, wherein said pump is removably mounted within said housing.

5. The dispenser of claim 4, wherein said housing is threadedly engaged with said container to permit securing said housing and said container together in a leakproof fashion.

6. The dispenser of claim 1, further comprising a platform movably mounted within said container to move from a full position in which said container is substantially full of the fluid, and an empty position in which said container is substantially empty of the fluid.

7. The dispenser of claim 6, wherein said platform is mounted within said container with a leakproof seal.

8. The dispenser of claim 6, wherein said platform may be accessed from the exterior of said container to allow for the dispensing of additional fluid in addition to the metered amount thereof.

9. The dispenser of claim 1 further comprising resilient biasing means for urging said pump into a desired position while dispensing the fluid.

10. The dispenser of claim 9, wherein said resilient biasing means is a spring.

11. The dispenser of claim 1, wherein the operation of said pump causes a vacuum to draw fluid out of said container.

12. The dispenser of claim 1, further comprising an outer cap threadedly engaged to said housing to protect said pump against unintended actuation.

13. A refillable portable travel dispenser for dispensing a fluid, the dispenser comprising:

a container having an interior for holding the fluid prior to the dispensing of the fluid;

an outlet for the fluid as it is dispensed;

a pump having a lower end which accesses said interior of said container and an upper end through which a metered amount of fluid may be conducted to said outlet, said pump having a one-way valve for preventing backflow of the fluid after the fluid has left said interior of said container;

a lock coupled to said outlet, said lock being rotatable between an open position in which the fluid may be dispensed through said outlet and a closed position in which the fluid is prevented from flowing through said outlet; and a housing in which said pump is removably mounted, said housing being threadedly engaged with said container to allow for securing said housing and said container together in a leakproof fashion;

whereby the dispenser may be at least partially disassembled to permit the refilling thereof.

14. The dispenser of claim 13, further comprising a platform movably mounted within said container with a leakproof seal, and configured to move from a full position in which said container is substantially full of the fluid, and an empty position in which said container is substantially empty of the fluid;

wherein said platform may be accessed from the exterior of said container to allow for the dispensing of additional fluid in addition to the metered amount thereof.

15. The dispenser of claim 13 further comprising a resilient spring for urging said pump into a desired position while dispensing the fluid.

16. The dispenser of claim 13, wherein the operation of said pump causes a vacuum to draw fluid out of said container.

17. The dispenser of claim 13, further comprising an outer cap threadedly engaged to said housing to protect said pump against unintended actuation.

18. A refillable portable travel dispenser for dispensing a fluid, the dispenser comprising:

a container having an interior for holding the fluid prior to the dispensing of the fluid;

an outlet for the fluid as it is dispensed;

a pump having a lower end which accesses said interior of said container and an upper end through which a metered amount of fluid may be conducted to said outlet, said pump having a one-way valve for preventing backflow of the fluid after the fluid has left said interior of said container;

a resilient spring for urging said pump into a desired position for dispensing the fluid;

a lock coupled to said outlet, said lock being rotatable between an open position in which the fluid may be dispensed through said outlet and a closed position in which the fluid is prevented from flowing through said outlet;

a housing in which said pump is removably mounted, said housing being threadedly engaged with said container to allow for securing said housing and said container together in a leakproof fashion;

a platform movably mounted within said container with a leakproof seal, and configured to move from a full position in which said container is substantially full of the fluid, and an empty position in which said container is substantially empty of the fluid;

wherein said platform may be accessed from the exterior of said container to allow for the dispensing of additional fluid in addition to the metered amount thereof; and whereby the dispenser may be at least partially disassembled to permit the refilling thereof.

19. The dispenser of claim 18, wherein the operation of said pump causes a vacuum to draw fluid out of said container.

20. The dispenser of claim 18, further comprising an outer cap threadedly engaged to said housing to protect said pump against unintended actuation.

* * * * *